United States Patent [19]

Hasty

[11] Patent Number: 4,864,782

[45] Date of Patent: Sep. 12, 1989

[54] TWO-PIECE FLASHING FOR ROOF VENT PIPES

[76] Inventor: William E. Hasty, 5230 Del Roy, Dallas, Tex. 75229

[21] Appl. No.: 136,610

[22] Filed: Dec. 22, 1987

[51] Int. Cl.[4] ..... E04D 13/14

[52] U.S. Cl. ..... 52/60; 52/199; 285/42

[58] Field of Search ..... 52/58, 60, 198, 199; 285/42, 43, 44; 277/12, 212 FB

[56] References Cited

U.S. PATENT DOCUMENTS

| | | | |
|---|---|---|---|
| 1,258,884 | 3/1918 | Fife | 285/43 |
| 1,615,929 | 2/1927 | Buckles et al. | 285/43 |
| 2,510,926 | 6/1950 | Goldstein | 285/43 |
| 3,098,663 | 7/1963 | Dibley | 285/43 |
| 3,313,559 | 4/1967 | Kifer | 285/43 |
| 4,160,347 | 7/1979 | Logsdon | 52/199 |
| 4,265,058 | 5/1981 | Logsdon | 52/58 |
| 4,333,660 | 6/1982 | Cupit | 52/60 |
| 4,526,407 | 7/1985 | Kifer | 285/42 |
| 4,563,847 | 1/1986 | Hasty | 52/58 |

FOREIGN PATENT DOCUMENTS

| | | | |
|---|---|---|---|
| 1310003 | 3/1973 | United Kingdom | 52/58 |

*Primary Examiner*—Michael Safavi

*Attorney, Agent, or Firm*—Fitzpatrick, Cella, Harper & Scinto

[57] ABSTRACT

An improved roof flashing comprising a hard base frustroconical base member and a elastomeric sealing collar, wherein the interconnection between the collar and base member is through overmolding a ring mount assembly, 6, that is characterized by a substantially horizontal upper surface and a pair of downwardly extending first and second legs, 12, 14. The proximate end of the sealing collar has a substantially horizontal upper surface and a pair of concentric lower surfaces, substantially coplanar but separated by the extending bottom of the second downward leg, 14. In this fashion, a bending moment supplied about a second downward leg, 14, through wiping action at the distal end of the elastomeric collar, 42, will not tend to separate the elastomeric collar from the frustroconical member, 4, at points radially outward from the second downward leg, 14.

5 Claims, 3 Drawing Sheets

TWO-PIECE FLASHING FOR ROOF VENT PIPES

BACKGROUND OF THE INVENTION

Field of the Invention

An improved two-piece flashing for roof top vent pipes, characterized by a hard plastic frustroconical base member and a sealing collar of softer, elastomeric material. The invention resides in the manner of joining the elastomeric sealing collar to a ring mount assembly on the frustroconical base member.

Brief Description of the Prior Art

Various prior art flashings are known wherein a flexible sealing collar permits various angles and sizes of vent pipes to be sealed against moisture, for range of roof pitch slope angles. For example, applicant's prior patent, HASTY, (U.S. Pat. No. 4,563,847) illustrates an improved universal flashing characterized by a one-piece elastomeric material wherein larger vent pipe diameters can be accomplished simply by separating one or more projections from a sealing ring collar. The exact type of elastomeric sealing collar used in the present invention is not critical. The critical aspect of the invention is the manner in which the elastomeric sealing collar has a proximate end that engages against a hard plastic ring mount assembly on the frustroconical member.

Examples of pertinent prior art, two-piece collar and hard base flashings are LOGSDON (U.S. Pat. No. 4,265,058) and KIFER (U.S. Pat. No. 4,526,407). LOGSDON '058 alleges criticality in an upwardly open channel, a plurality of sealing flanges that extend circularly around the wall to project radially inward, together with an annular skirt that must be molded downwardly into that channel. KIFER '407 critically requires a closed-loop type of overmolding technique, and specifically alleges a more water-tight seal between the collar and the hard base, than realizable with an upwardly open channel design, such as taught by LOGSDON '058. The term "overmolding" herein is used in its conventional sense, to describe molding of a collar directly upon a flange of a base member by injecting an elastomeric collar material into a mold cavity that is clamped or otherwise surrounding the flange, so that the overmolded collar material will fuse to the flange to make an interconnection.

Other pertinent examples of known ways to engage the top and bottom of a horizontal flange are the earlier patents to FIFE (U.S. Pat. No. 1,258,884), BUCKLES et al. (U.S. Pat. No. 1,615,929), DIBLEY (U.S. Pat. No. 3,098,663), and KIFER (U.S. Pat. No. 3,313,559). Each of these patents illustrate simpler techniques for molding or otherwise mounting a soft, elastomeric collar into a harder material base, and in each approach a channel-type interconnect or a simple overmolding is employed.

The present invention is characterized by a single-size hard base, with elastomeric collars which may be universal, or individually sized to accommodate three-inch, two-inch and 1.5 inch vent pipes, for example. The present invention combines structural improvements to a ring mount assembly with overmolding, so that a greater resistance to bending moments and the possibility of water entry is achieved. Applicant's mounting categorically involves a ring mount assembly having a generally planar upper surface, a first downward leg relatively inward on a ring mount assembly, and a second downward leg, relatively outward on the ring mount assembly. The ring mount assembly preferably further comprises eight oval slots, and eight C-shaped slots, spaced circumferentially on either side of the second downward leg.

As such, the present invention is distinguished from prior art approaches by an elastomeric collar which has greater resistance to bending moments, so that the forces applied to the distal end of the collar, (from a contact with a vent pipe), will not bend the entire proximate end of the elastomeric collar around the ring mount assembly. The present invention permits both a certain amount of flexibility, and a point of rotation that is generally about the diameter of the second downward leg, so that a sealing between the base and the collar radially outward therefrom will not be destroyed.

BRIEF SUMMARY OF THE INVENTION

The present invention comprises an improved technique for mounting an elastomeric collar to a frustroconical member, and a preferred embodiment wherein different size elastomeric collars may be mounted to a common frustroconical member. As noted hereinbefore, a universal elastomeric collar ring, of the type shown in HASTY (U.S. Pat. No. 4,563,847) also is contemplated. The hard base of the present invention is a frustroconical member of heat-resistant thermoplastic material, as is well known for that purpose. Rigid PVC plastic or ABS plastic may be used, or any plastic sufficiently rigid and able to withstand the temperatures of roof tar, for example, which may come into contact with the hard base. The elastomeric collar is much softer, and preferably is injection molded of a soft elastomeric material such as flexible PVC plastic. Flexible PVC is known to have excellent sealing properties and resistance to aging, and can be easily molded to accommodate any particular vent pipe diameter that will be as encountered in an intended use. While the preferred embodiment show a hard plastic base and a soft elastomeric collar, (and the terms "hard base" and "soft collar" hereafter will be used), it is to be understood that various hard materials, such as rigid plastics, aluminum, or galvanized steel, could be used to create the construction defined hereafter for the hard base. Likewise, while flexible PVC is the preferred elastomeric collar material, various other sealing rubbers, well known for this purpose, may be substituted.

The present invention is, therefore, the combination of an overmolded soft elastomeric collar material over a hard plastic base material, with the overmolding resulting in an interlock between the parts that has surprisingly efficient consequences during use. The hard base comprises a ring mount assembly with a generally planar upper surface, a plurality of oval slots cut along an outer circle, proximate the wall member, and a plurality of inner cut-outs, opening inwardly along the inner vertical surface of the flange. The flange bottom is generally planar, but further comprises a pair of downwardly extending legs. The inner leg will be defined hereafter as a first downward leg, and the relatively outer leg will be defined as a second downward leg. The inner cut-outs selectively interrupt the circumferential extent of the first downward legs, but the second downward leg defines a continuous annular lower surface which extends below the lowest horizontal molding point of overmolded elastomeric collar material.

The two downward legs stiffen the flange, and cooperate to prevent separation between the overmolded collar and the inner portion of the flange when the flashing is initially pushed down over a vent pipe. The overmolded elastomeric collar material surrounds the first downward leg in a complete clamping fashion to define a C-shape. The first downward leg is discontinuous, circumferentially, only with respect to the inwardly open cut-outs on the flange. The second downward leg defines, and separates, first and second lower horizontal surfaces to the overmolded elastomeric collar material. Therefore, first and second concentric, annular lower horizontal collar material surfaces are defined. Above the outer annulus of elastomeric collar material, preferably eight oval locking sections vertically interconnect the upper and lower horizontal regions of the overmolded elastomeric collar. The overmolded collar has a horizontal upper surface with a proximate end that fills into a notch at the outer edge of the frustroconical member upper surface. In this manner, a water-tight transition between the top of the collar and the frustroconical side of the hard base is defined.

A locking action between collar and base from each of the oval slots and the outer lower annulus is unaffected by bending moments applied to the ring mount assembly through rotations occuring from a vent pipe contact. The second downward leg effectively separates and provides a strain relief between the two annular, lower horizontal lower surfaces of the overmolded collar material.

For a further understanding of the objects and advantages of the present invention, a preferred embodiment hereafter is described, wherein reference is made to the accompanying drawings.

DESCRIPTION OF THE PREFERRED EMBODIMENT

Figure 1:
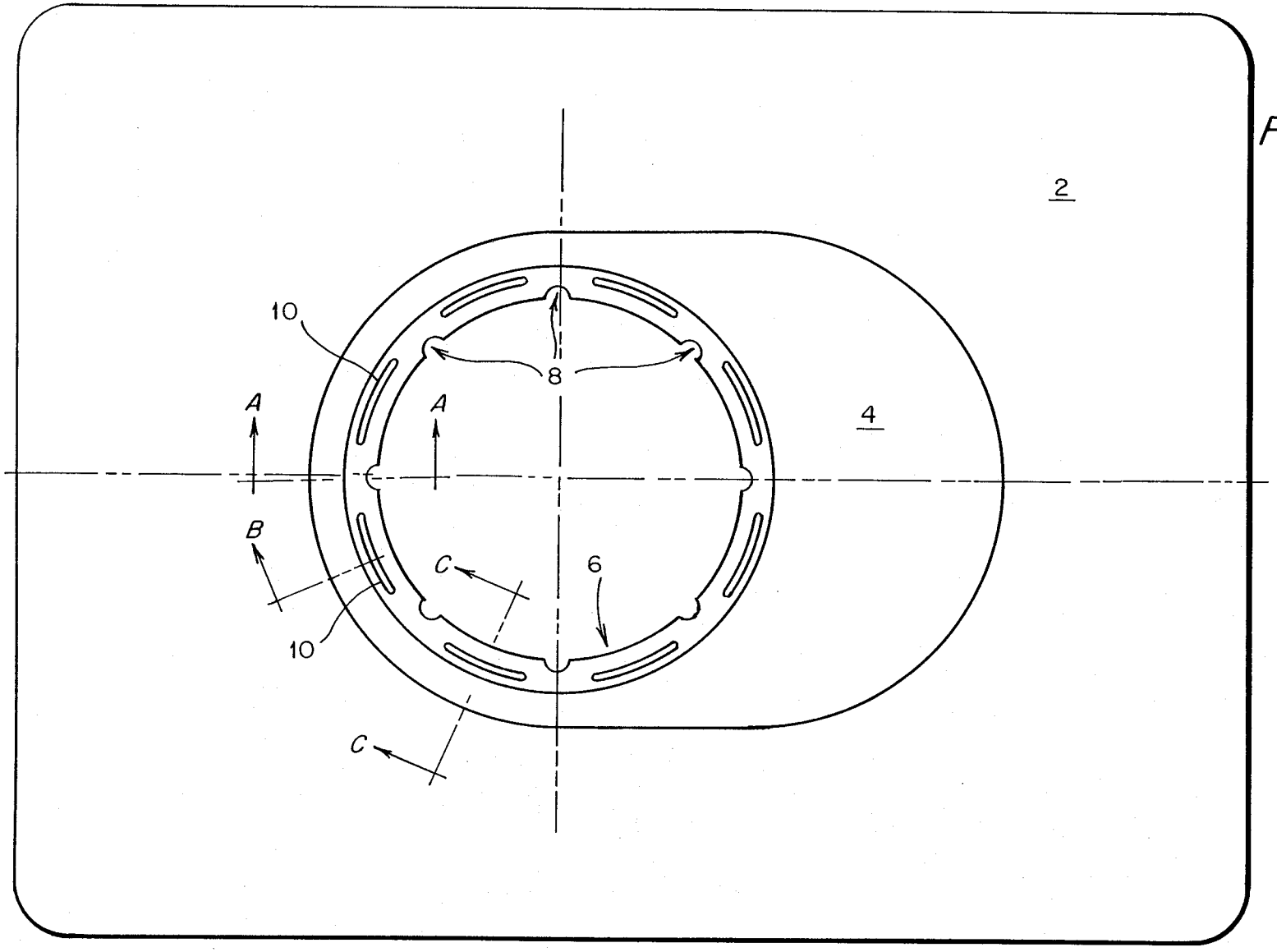
FIG. 1 is a top plan view of a hard base according to a preferred embodiment of the present invention.

FIG. 1 shows in top plan view a novel hard base which essentially comprises a flat base, 2, a frustroconical member, 4, and a ring mount assembly having a planar upper surface, 6. Within the ring mount assembly are disposed eight inwardly open cut outs around the inner circumference, and eight elongated oval slots, 10, radially outward therefrom. The open cut outs and the oval slots extend vertically through the width of the flange of the ring mount assembly, 6. As can be seen from FIG. 1, the inner and outer boundaries of the ring mount assembly, 6, are concentric, and the radius of the inner surface is preferably approximately 2.9 inches, and the radius of the outer surface is approximately 3.33 inches.

Figure 2:
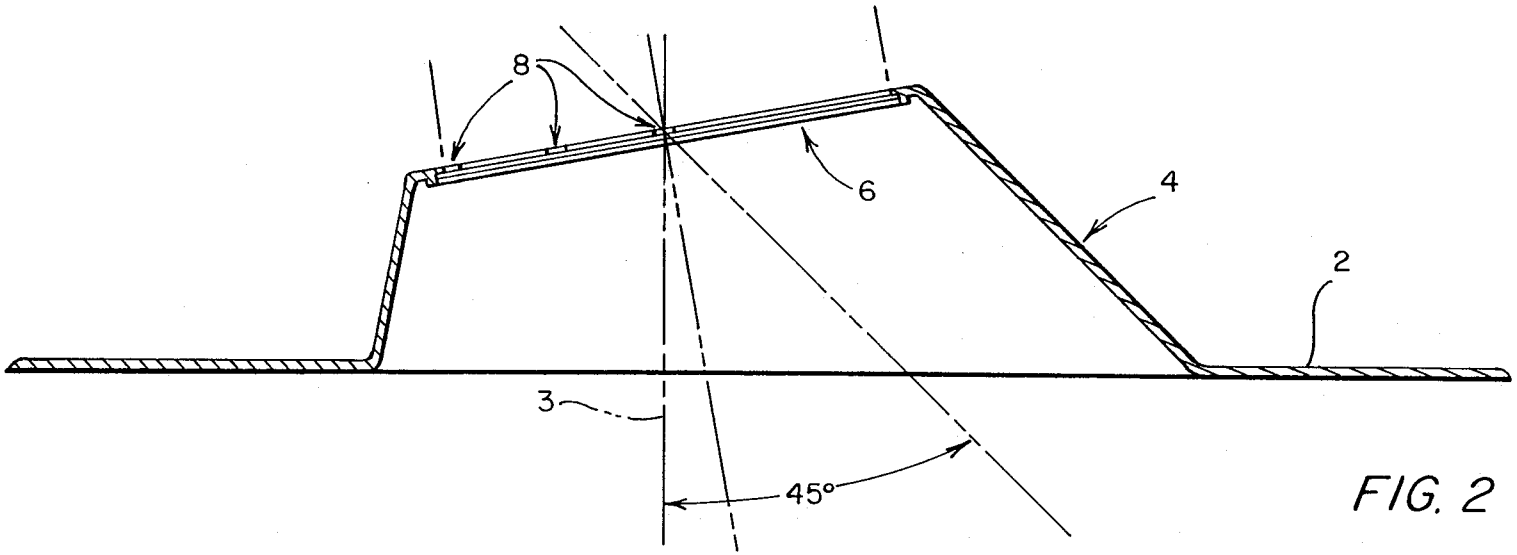
FIG. 2 is a cross-sectional elevation view taken through the hard base along line A—A of FIG. 1.

FIG. 2 is a vertical section elevation view along line A—A of FIG. 1, and shows the angle of the frustroconical member, 4, with respect to its flat base, 2, and the ring mount assembly, 6. For reference, a 45° center line is shown, which is roughly parallel to the long wall of the frustroconical member, 4. Also shown is a perpendicular line, 3, for a reference to the plane of the flat base, 2. Both FIGS. 1 and FIG. 2 show the hard base alone. The hard base substantially defines the final structure of the elastomeric collar, since it is overmolded directly upon the flange surface of the hard base. Hence, it is more critical to understand the structure of the hard base, and reference may be had to FIG. 5 for details of how the overmolded elastomeric collar is finally situated upon the hard base.

Figure 3:
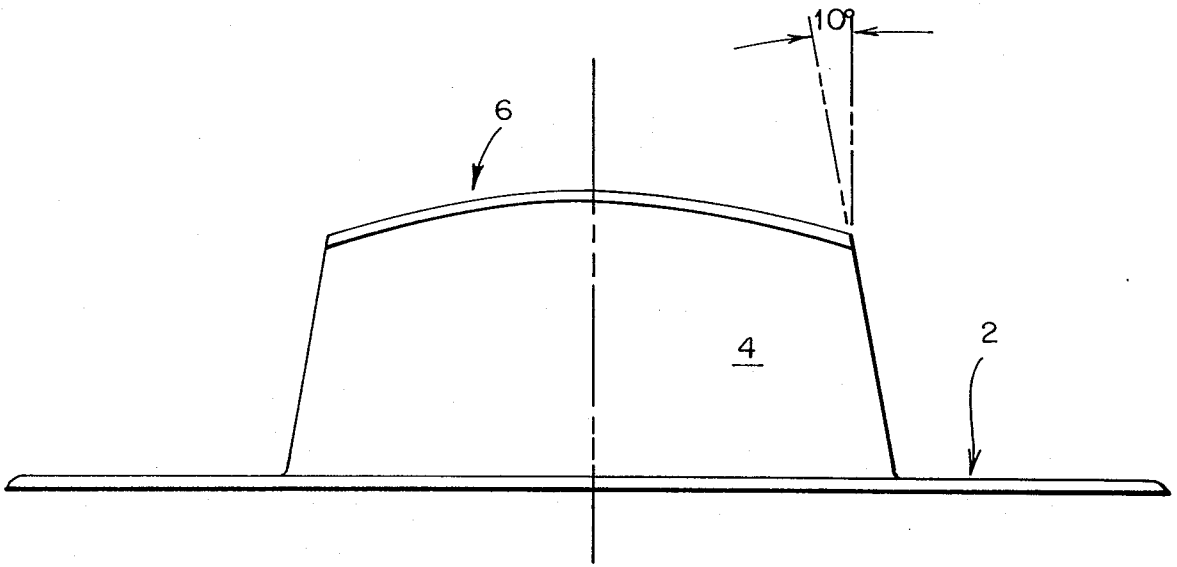
FIG. 3 is a left-side elevation view of the flashing of FIG. 1, wherein the right side is substantially a mirror image.

FIG. 3 is a left-side elevation view of the hard base of FIG. 1, and illustrates simply that the flange, 6, appears to have a slight curvature when viewed from a perspective angle to the plane of flange, 6, as shown in FIG. 2. FIG. 3 further illustrates that the side walls of the frustroconical member, 4, may be inclined at approximately 10°.

Figure 5:
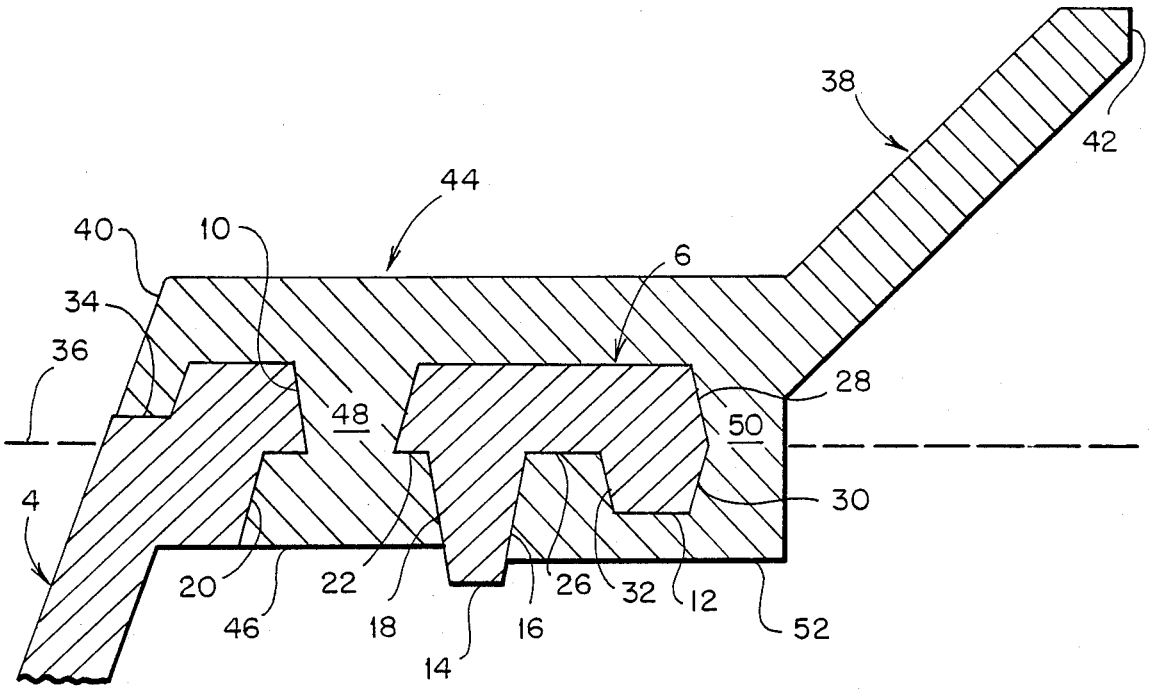
FIG. 5 is a partial section detail view along section C—C of FIG. 1, further showing the combination of a hard base with overmolded elastomeric collar.
Figure 4:
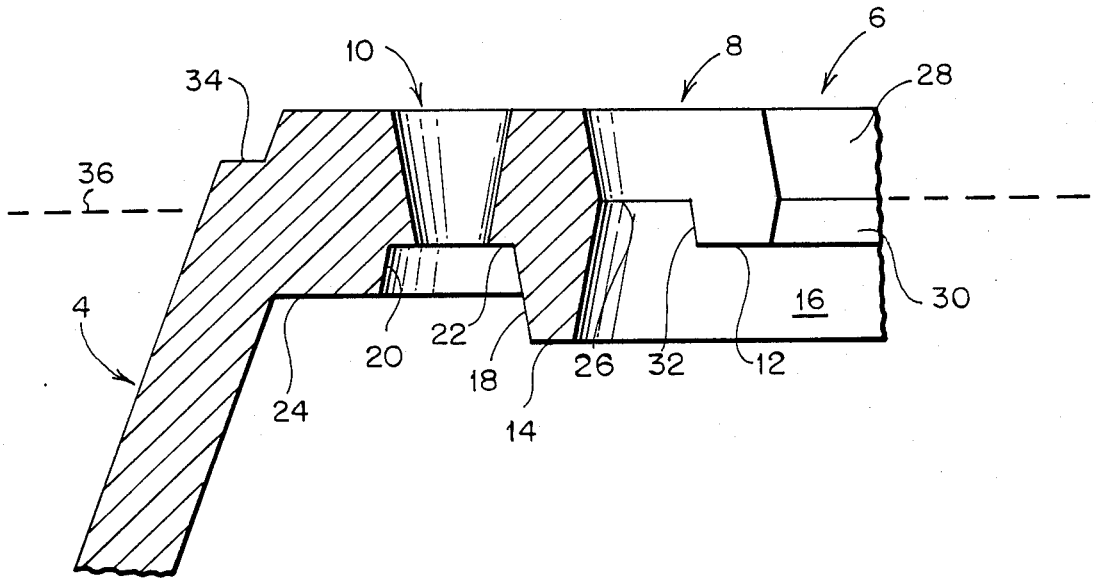
FIG. 4 is a partial section detail view along line B–A of FIG. 1.

FIG. 4 illustrates a detail section view of the flange shown generally in FIGs. 1 and 2. The ring mount assembly, 6, has a plurality, (preferably eight), of open cut outs, 8, and a plurality, (preferably eight), of oval slots, 10. A dotted line, 36, is shown for reference, to represent a mold parting line useful with an overmolding cavity (not illustrated) when injection molding the elastomeric collar to ring mount, 6, of hard base, 4. As is known, a parting line represents the intersection of upper and lower parts of an overmolding cavity, of the clamp or mold type. The ring mount, 6, further comprises a first downward leg, having a bottom surface, 12, which is relatively inward. A second downward leg has a bottom surface, 14, and is relatively outward. The second downward leg extends significantly below the parting line, 36, while the bottom surface of the first downward leg is substantially coplanar with the parting line, 36. The second downward leg, 14, further is defined by an inner annular surface, 16, and an outer annular surface, 18. An annular ridge, 20, is complementary to outer annular surface 18, in the vicinity of one of the oval slots, 10. As shown in FIG. 5, a rivet-like engagement can occur between soft material filling oval slot, 10, since upward movement is prevented by shoulder, 22, below the oval slot.

The lower flange also comprises a horizontal outer bottom surface, 24, and a horizontal inner bottom surface, 26, which respectively are below and above the parting line, 36. A flange curved inner vertical surface, 28, extends downwardly from the ring mount assembly upper surface, 6, and meets at an angle with the first leg curved inner vertical surface, 30. The first leg also has a curved outer vertical surface, 32, with both vertical surfaces being spaced above the parting line, 36.

As shown by FIG. 1, the section line B–A has been defined so as to show in FIG. 4 the details of both the representative oval slot, 10, and the representative inner cut out, 8. FIG. 5, by contrast, shows a linear section line, C—C, which is taken along a radii of the ring mount assembly, 6. FIG. 5 also shows how an elastomeric sealing collar, 38, has been overmolded upon the ring mount assembly, 6.

The elastomeric sealing collar, 38, generally comprisea a proximate end, 40, and a distal end, 42. The distal end can extend radially inward to accommodate a particular outer diameter of a vent pipe, and manifestly may further comprise any conventional wiping construction. Hence, the shape of distal end, 42, need not be further described in order to appreciate the present invention. The elastomeric sealing collar further has a horizontal upper surface, 44, a horizontal outer bottom surface, 46, and a horizontal inner bottom surface, 52. As can be appreciated from FIG. 5, the horizontal outer bottom surface, 46, defines an uninterrupted annulus from a bottom plan view, looking upwardly from inside the assembly. The horizontal inner bottom surface, 52, also defines a concentric annulus, from that same perspective. The two annuli, 46, 52, are separated by the annular, downwardly extending second leg bottom surface, 14, which is both significantly below the parting line 36 and also below the horizontal plane of either lower surface, 46 or 52. As such, the second downward leg, 14, acts as a strain relief between the two elastomeric rubber section surfaces, 46, 52. Hence, as can be seen in FIG. 5, a clamping engagement is defined by a C-shaped collar locking portion, 50, while a rivet-like locking portion, 48, is defined within each of the oval slots, 10.

With reference to FIG. 5, it can now be appreciated that any upward forces at distal end 42 will become counterclockwise bending moments about a fulcrum at second downward leg, 14. Hence, upward wiping forces exerted upon distal end of the collar, 42 will be isolated from the rivet-like locking portion, 48. Any tendency for the elastomeric sealing collar, 38, to rotate around the circumference of ring mount assembly, 6, is resisted, firstly, by the series of oval locking portions, 48, and secondly, by overmolded material within each cut-out, 8 (not shown in FIG. 5). The FIG. 5 section view along line C—C illustrates that collar clamping portion, 50, can rotate and function independently of the rivet-like portion, 48. Any tendency of collar clamping portion 50 to rotate clockwise or counterclockwise about second downward leg, 14, also is resisted by a significant mass of elastomeric rubber material that fills in the space between first downward leg, 12, and second downward leg, 14. Hence, overmolded material will contact opposing vertical surfaces, 16, 32, and horizontal surface, 26, between the first downward leg, 12, and the second downward leg, 14. The two downward legs also define an internal channel member which is relatively rigid, so that any tendency for separation between clamp portion, 50, and second downward leg, 14, is minimized.

It further should be appreciated from FIG. 5 that the sealing collar proximate end, 40, engages for a smooth contour within a frustroconical member notch, 34, to minimize water seepage from the outside of hard base, 4, to within the interior below surface, 46, for example. Since the collar has a horizontal, outer bottom surface, 46, that is not physically connected to collar, horizontal inner bottom surface, 52, bending movement of the inner section will not cause the seal between notch, 34, and lower surface, 46, to separate.

In the preferred embodiment, the overmolded material is supplied through a clamp mold that has a horizontal parting line, 36, substantially as shown. The end result of the injection molding process will be the final structure, of FIG. 5. The preferred material for the elastomeric collar is flexible PVC, although other well-known elastomeric materials may be used. The preferred material for the hard base, 4, is a rigid plastic of the polypropylene or polyethylene family, such as novalene, sold by Nova Polymers, Inc. of Evansville, Ind. Alternatively, the hard base configuration may be bent into aluminum or a galvanized steel.

While applicant has described a preferred embodiment of his invention, the scope of the invention is to be defined by the scope of the appended claims.

I claim:

1. In a two-piece flashing comprising a frustroconical hard base member adapted to be secured to a roof, with a substantially circular upper ring mount assembly that has been overmolded to define an interconnection between said ring mount assembly and a superposed elastomeric soft collar that is adapted to seal against the outer diameter of an upstanding pipe passing through a central opening in said collar, the improvement which comprises, in combination, a ring mount assembly (6) comprising a substantially horizontal upper surface, a first plurality of cut-outs (8) around an inner vertical surface thereof, a second plurality of slots (10) vertically extending through the ring mount assembly and spaced radially outward from the cut-outs, and a substantially horizontal lower surface from which extends a first downward leg (12), proximate the inner surface of the ring mount assembly, and a second downward leg (14) that is spaced radially outward therefrom, wherein said elastomeric collar (38) comprises overmolded elastomeric collar material (50) that encloses the cut-outs and the first downward leg to define a horizontal inner bottom surface (52) and overmolded elastomeric collar material (48) also extends vertically through said slots to define a horizontal outer bottom surface (46), wherein a bottom surface of the second downward leg (14) extends below and separates the respective inner and outer horizontal bottom surfaces (52, 46) of said collar, whereby bending moments supplied to interconnections between the elastomeric sealing collar and ring mount assembly will be relieved in the vicinity of the second downward leg.

2. An improved roof flashing according to claim 1, wherein said elastomeric collar further comprises a proximate end that engages an outer diameter of said ring mount assembly and a distal end, (42) that extends angularly inwardly and upwardly from said ring mount assembly, wherein further said elastomeric collar comprises a substantially horizontal upper surface in the vicinity of the ring mount assembly and two substantially horizontal lower surfaces comprised of concentric, annuli (46, 52) separated by the second downward leg (14), and said ring mount assembly is enclosed by a C-shaped collar locking portion (50) of overmolded elastomeric material.

3. A roof flashing according to claim 2, wherein said plurality of outer slots comprise ovals (10) spaced equally about the circumference of the flange (6), and are elongated so as to occupy approximately one half of the circumferential center line of said ovals around said flange, and said elastomeric sealing collar material extends downwardly through said oval slots to form a rivet-like head (48) against an outer annular surface of the second downward leg (18) and an annular ridge (20) defined on the inside wall of said frustroconical member.

4. An improved flashing according to claim 2, wherein said inner cut outs (8) are C-shaped, open inwardly upon a flange inner vertical surface (28), and are spaced symmetrically about the inner vertical surface of said ring mount assembly, wherein said overmolded elastomeric sealing collar locking portion (50) encompasses each of said C-shaped cut outs (8) while also clamping about said first downward leg (12).

5. An improved roof flashing according to claim 4, wherein said overmolded elastomeric sealing collar locking portion (50) clamping about said ring mount assembly (6) is spaced above and below a parting line

(36) that is substantially horizontal and spaced below the ring mount assembly upper surface, wherein further a horizontal upper surface of the overmolded material (44) is spaced approximately an equal amount above the parting line as are concentric, annular, outer and inner lower horizontal surfaces of the sealing collar (46, 52), wherein further the second downward leg has a bottom surface (14) which extends substantially below a plane of the outer and inner lower horizontal surfaces (46, 52) of the elastomeric collar.

* * * * *